United States Patent [19]

Rao et al.

[11] Patent Number: 4,744,216

[45] Date of Patent: May 17, 1988

[54] ELECTRICAL IGNITION DEVICE FOR REGENERATION OF A PARTICULATE TRAP

[75] Inventors: V. Durga N. Rao, Bloomfield Township; Michael G. Aimone, Westland, both of Mich.

[73] Assignee: Ford Motor Company, Dearborn, Mich.

[21] Appl. No.: 921,028

[22] Filed: Oct. 20, 1986

[51] Int. Cl.[4] ..... F01N 3/02

[52] U.S. Cl. ..... 60/303; 55/466; 55/DIG. 30; 422/174

[58] Field of Search ..... 60/303, 286, 274; 55/DIG. 30, 466; 422/174

[56] References Cited

U.S. PATENT DOCUMENTS

| | | | |
|---|---|---|---|
| 4,359,863 | 11/1982 | Virk | 60/303 |
| 4,427,418 | 1/1984 | Kogiso et al. | 55/287 |
| 4,449,362 | 5/1984 | Frankenberg | 60/286 |
| 4,516,993 | 5/1985 | Takeuchi et al. | 55/283 |
| 4,523,935 | 6/1985 | Takagi et al. | 55/282 |
| 4,544,388 | 10/1985 | Rao et al. | 55/282 |

FOREIGN PATENT DOCUMENTS

| | | | |
|---|---|---|---|
| 67914 | 4/1983 | Japan | 60/303 |
| 520 | 1/1984 | Japan | 60/303 |

*Primary Examiner*—Douglas Hart

*Attorney, Agent, or Firm*—Joseph W. Malleck; Roger L. May

[57] ABSTRACT

An ignition system is disclosed for regenerating a particulate trap (40–400 cells per lineal inch) used to filter the exhaust gas of an internal combustion engine, the particulate trap having an entrance face for receiving a gaseous flow therethrough. The system comprises: (a) flow guide means effective to direct a gaseous flow to such entrance face during filtration and during regeneration of the trap; (b) an open cell ceramic foam body (10–30) cells per lineal inch) extending across such flow guide means and having (i) a radially outer ring exit surface in contact with the radially outer portion of the entrance face, and (ii) an entrance throat remote from the particulate trap, the open cell foam body being effective to trap an ignitable collection of particulates from the exhaust gas during filtration; and (c) electrically energized resistance heating means stationed in a radially central portion of the open cell body adjacent to the entrance throat effective to heat the body during regeneration to a temperature effective to ignite the ignitable collection. The foam body is preferably shaped in a frusto-conical configuration having a neck to for said entrance throat at one end and an opposite end having a base perimeter defining the outer periphery of the ring surface; the neck of the foam body preferably has cast-in-place therein electrical resistance heating wires; the cross-sectional area of the neck is no greater than 20% of the cross-sectional area of the trap entrance face.

14 Claims, 2 Drawing Sheets

ELECTRICAL IGNITION DEVICE FOR REGENERATION OF A PARTICULATE TRAP

BACKGROUND OF THE INVENTION

1. Field of the Invention

The invention relates to the technology of regenerating a particulate trap used to remove particulates from the exhaust gases of an automotive internal combustion engine and, more particularly, to an ignition device which more economically ignites the particulates to initiate regeneration. This application is an improvement related to U.S. Pat. No. 4,544,388, by the same inventors, directed to apparatus that permits electrically energized regeneration.

2. Description of the Prior Art

Electrical heating elements have been devised to ignite particulate collections in porous traps or filters for internal combustion engines, particularly for diesel engines. Particulates, in case of diesel exhaust emissions, is a term used herein to describe carbonaceous solids and condensible matter as defined by the U.S. Environmental Protection Agency. To date such heating elements have been either (a) embedded at or near the front face of the particulate trap (filters having a high trapping efficiency in the range of 50–90%) to ignite the dense particulate collection for removal by oxidation (see U.S. Pat. Nos. 4,516,993 and 4,523,935), or (b) have been embedded in a support element (an element providing little or no trapping efficiency) up stream from the particulate trap to heat the gaseous flow to an adequate temperature which, in turn, ignites the front part of the particulate collection in the trap (see U.S. Pat. Nos. 4,544,388 and 4,427,418).

In either case the ignition temperature required is relatively high demanding that the power wattage be at a level of at least 1500 watts or more to raise state-of-the-art resistance elements to above that temperature. This results from two factors. First, the electrical resistance means only indirectly heats the particulates because the gaseous flow passing therethrough is heated directly and, in turn, heats the particulates. Particulates must be heated to a level of at least a 1000° F. in order to ignite unless subjected to a catalyst which lowers the ignition temperature to the range of 800° F. Secondly, the electrical heating means heats the entire cross-sectional area of the entrance of the particulate trap which is a very extensive area requiring greater heat content. Thirdly, the particulate collection, as contained in a wall-flow particulate filter, exposes only the edges of the particulate columns to the frontal flow which reduces the effectiveness of heated gaseous flow to achieve ignition. [A wall-flow particulate trap has columns which present cells to the front face of the flow, the cells being relatively few per square inch across such face; alternate columns or cells are closed forcing the flow to penetrate laterally or sideways through the wall before being permitted to exit in an alternate cell or channel.]

What is needed is an electrical ignition device which requires considerably less energy to ignite the particulate collection. Such device should provide for heating directly a small siphoned quantity of the particulates independent from the primary dence collection of particulates; such siphoned quantity is non-layered so that it can be easily heated by conduction from electrical wires adjacent to the particulates. Such device needs to be exposed to only a small portion of the area of the flow, such as 20% or less, to be effective.

SUMMARY OF THE INVENTION

The primary object of this invention is to provide a more effective ignition system for a bypassable wall-flow particulate trap of an internal combustion engine.

It is another object to provide such an electrical ignition system which regenerates at lower cost by heating only a central core of an omni-flow filter which has a relatively open pore characteristic to siphon only a light amount of soot during the normal filtration period of the exhaust gases.

It is also an object to provide such an electrical ignition system which is effective to heat directly, by conduction, a siphoned collection of particulates useful for ignition purposes; such siphoned collection of particulates, when ignited, is used to directly heat the primary dense collection of particulates by conduction radiation and connection.

To achieve the above objects, the invention is an ignition system for regenerating a particulate trap used to filter the exhaust gas of an internal combustion engine, the particulate trap having an entrance face for receiving a gaseous flow therethrough. The system comprises: (a) flow guide means effective to direct a gaseous flow to such entrance face during filtration and during regeneration of the trap; (b) an open cell ceramic foam body extending across such flow guide means and have (i) a radially outer ring exit surface in contact with the radially outer portion of the entrance face, and (ii) an entrance throat remote from the particulate trap, the open cell foam body being effective to siphon off an ignitable collection of particulates from the exhaust gas during filtration; and (c) electrically energized resistance heating means stationed in a radially central portion of the open cell body adjacent to the entrance throat effective to heat the body during regeneration to a temperature effective to ignite the ignitable collection.

Preferably the open cell ceramic foam body has a porosity which provides 10–30 cells per lineal inch while the particulate trap is comprised of a wall-flow ceramic having 40–400 cells per lineal inch. The foam body is preferably shaped in a frusto conical configuration having a neck to for said entrance throat at one end and an opposite end having a base perimeter defining the outer periphery of the ring surface; the neck of the foam body preferably has cast-in-place electrical resistance heating wires; the cross-sectional area of the neck is no greater than 20% of the cross-sectional area of the trap entrance face. Preferably the ceramic foam body has a pocket therein located radially inwardly of the ring surface to provide a separation between the body and trap, thereby forcing transferred heat through the ring surface. Advantageously the ratio of the diameter of the neck of such ceramic foam body to the exit base thereof is in the range of $\frac{1}{3}$ to $\frac{3}{4}$. Advantageously the ceramic foam body is effective to collect 0.3–1.0 grams of soot for purposes of providing an ignitable collection. Preferably the ratio of the soot collected in the wall-flow particulate trap during a given filtration period is in the ratio of 1/30 to 1/100.

Preferably the resistance heating means is energized to provide 800–1100 watts of heating, the resistance heating means being supplied with an electrical current of about 20 amps at a voltage of about 45. Advantageously the ceramic foam body contains a washcoat thereon comprising a catalyst (palladium plus tungsten)

for reducing the ignition temperature of said siphon particulate collection to about 400°-800° F.

The gaseous flow carried through said flow guide means is preferably exhaust gas during the filtration period and air during regeneration period. The flow rate of said exhaust gas during filtration is in the range of 100-1500 cfm and the air flow during regeneration is preferably in the range of 1.5-15 cfm.

Preferably the particulate trap is comprised of a wall-flow type design whereby longitudinally extending cells of said trap are alternately closed at the face thereof, the wall thickness of said trap of each of the said cells is about 0.01 inch and each of said cells have a square cross-section with a side of about 0.09 inches.

DETAILED DESCRIPTION AND BEST MODE

The regeneration system utilizes an electric heating assembly that heats a ceramic foam body to ignite a low density particulate collection carried thereon when in the presence of air passing thereover; the combustion of such thin collection of particulates raises the temperature of the ceramic foam body to transfer heat through radiation and through a ring contact with the front face of the particulate trap and raises the temperature of the air flow therethrough to transfer heat by connection. The leading portion of the collection of particulates in the trap is ignited by such heat transfer. The only source of energy is that supplied to the electrical resistance heating wires cast-in-place in a radially central portion of the ceramic foam body, the wires therefore being limited in size and area for heating with less wattage is required for such resistance heating.

Figure 1:
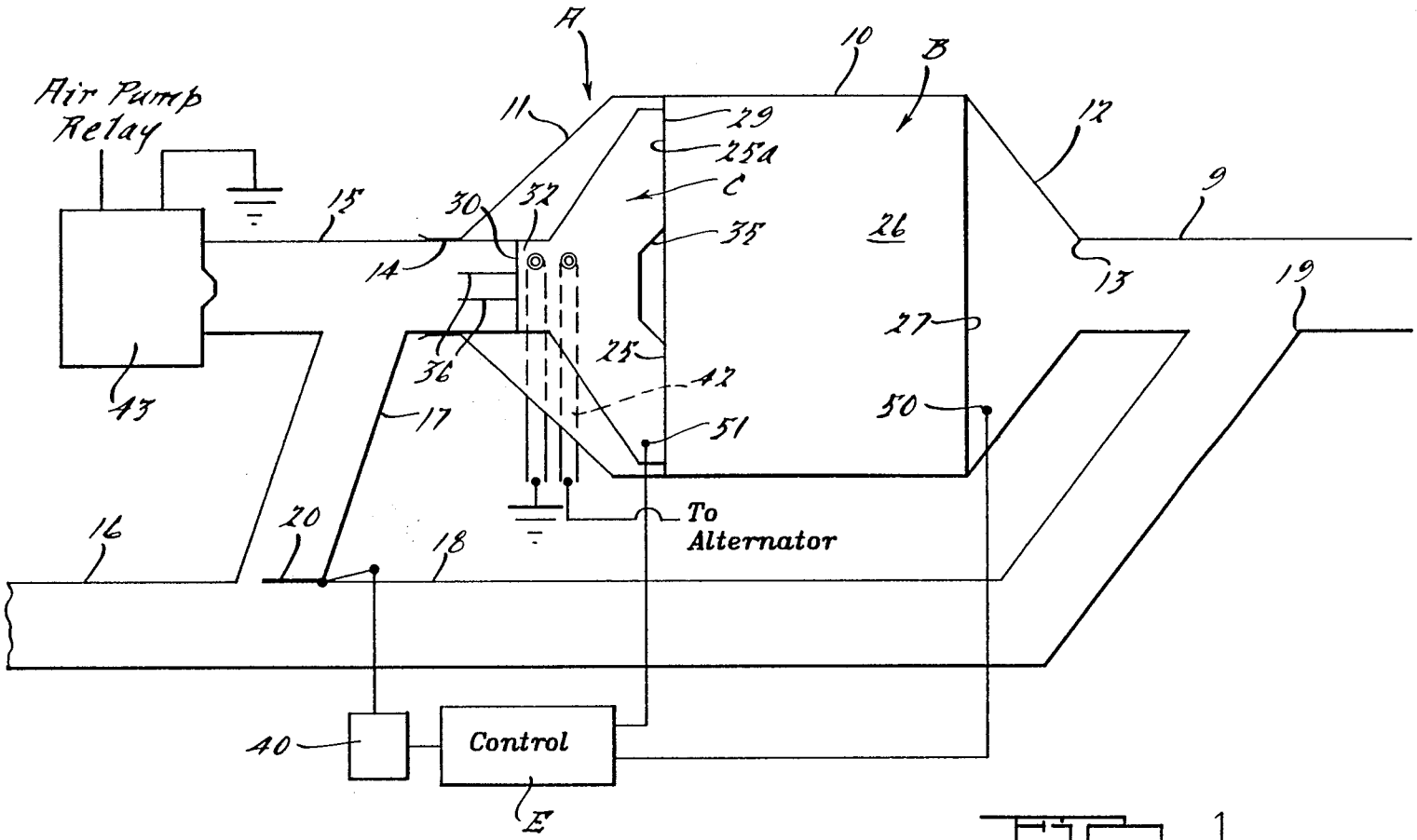
FIG. 1 is a schematic diagram of an automotive filter trap and regeneration system embodying the principles of this invention.
Figure 2:
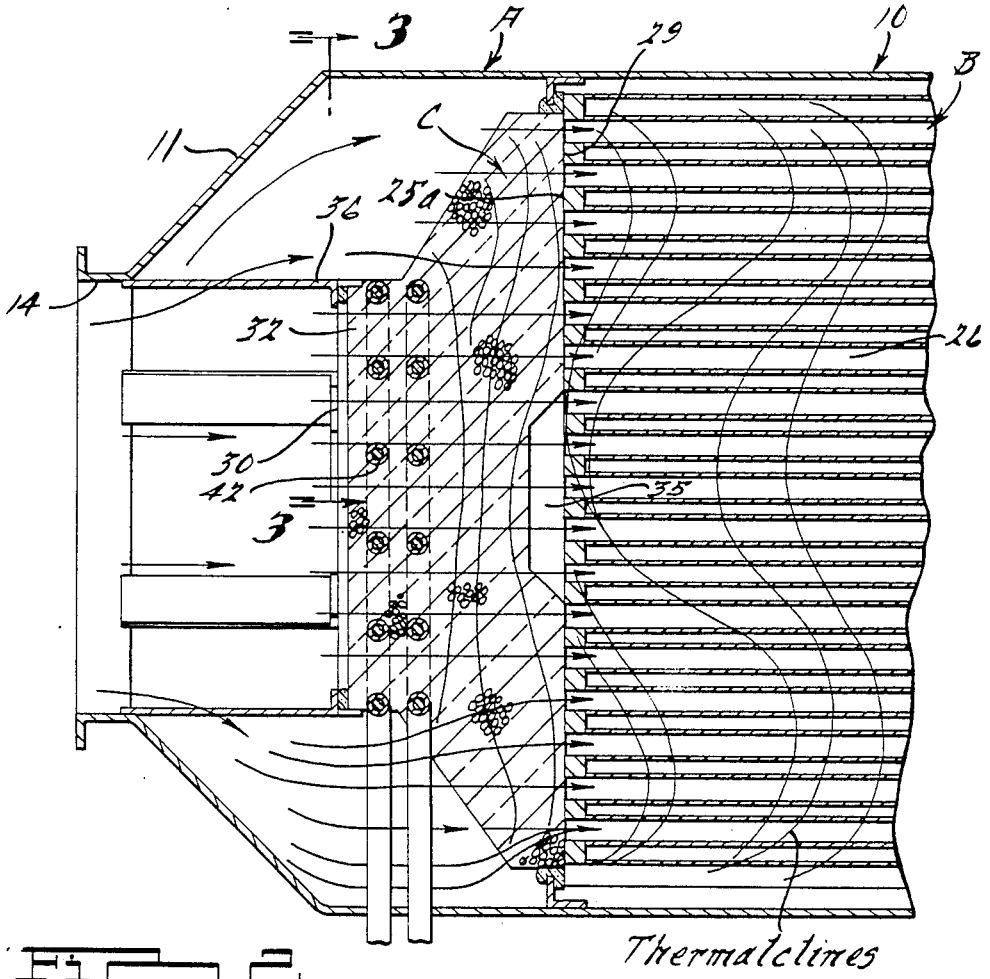
FIG. 2 is an enlarged central sectional view of a leading portion of the filter trap and the heating means employed to ignite the particulate collection in the filter trap.
Figure 3:
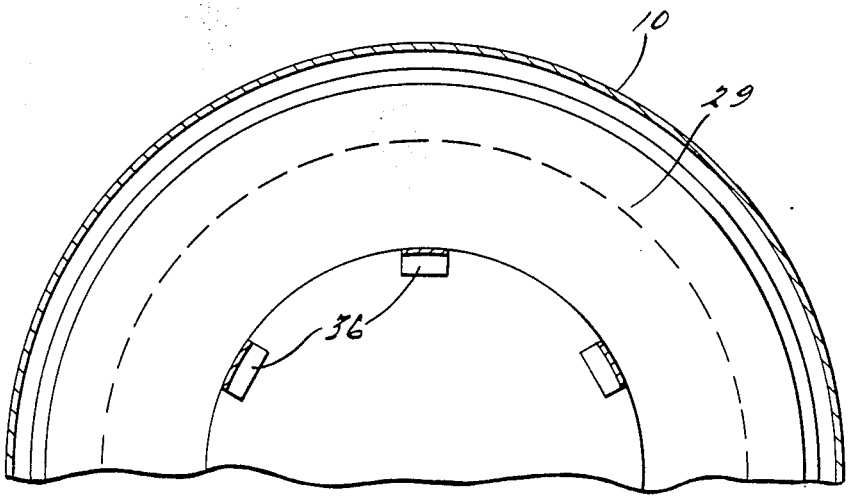
FIG. 3 is a sectional view taken substantially along line III—III of FIG. 2.

As shown in FIG. 1, the apparatus for the trap and regeneration system broadly comprises a flow guide assembly A, a particulate trap B, a ceramic foam body C, an ignition assembly D and a control E.

Flow Guide Assembly

The flow guide assembly A is comprised of a canister 10 effective to contain and support the trap B in manner so that the entire flow passes through such trap. The canister has a leading transition or entrance section 11 and an exit transition section 12, the transition sections respectively being connected at station 14 to a tubular entrance passage 15 and at station 13 to an exit tube 9. The flow guide assembly is of the bypass type, that is, the exhaust flow from the engine, conveyed by exhaust pipe 16, is allowed to enter the entrance section 11 byway of a passage 17 during normal filtering operation; during regeneration, the exhaust flow is bypassed through a channel 18 by closing passage 17 by use of diverter valve 20 (the valve is moved from its first position, closing channel 18 and allowing flow through passage 17, to a position opening channel 18 and closing passage 17). The exhaust is bypassed to converge with the exit passage 9 at station 19. The diverter valve assembly may be of the flapper type actuated by vacuum motor 40 to move the flapper valve from a normally biased position, to an actuated position. The vacuum motor is electrically actuated under a control E.

Filter Trap

The filter trap B has a monolithic ceramic honeycomb cell structure 26 supported and contained in the metallic canister 10, the front portion of the canister guiding the flow of exhaust gases from channel 17 through the front face 25 of the ceramic honeycomb cell structure. The honeycomb cell structure may be similar to that used for carrying a catalyst material for conversion of gases from a gasoline engine. The monolithic structure contains parallel aligned channels constituting the honeycomb cell structure. The ends of the channels are alternately blocked with high temperature ceramic cement at the front and the rear so that all of the inlet flow of gas must pass through the porous longitudinally extending side walls of the channels before exiting through a rear open channel of the filter trap. This type of monolithic ceramic structure provides very high filtration surface area per unit of volume. For example, a 119 cubic inch filter trap of this type with 100 cells per square inch and a 0.017 inch wall thickness will provide approximately 1970 square inches of surface area; the filtering surface area per unit volume for such a filter trap would be about 16.6 square inches per cubic inch. The channels are all preferably aligned with the direction of the flow of 17 through the trap. When particulates collect on the trap they will nest within the porosity of the walls spaced along the direction of flow. Thus, there can be a generally uniform distribution of particulates as they are collected along the length of the trap. Preferably the monolithic structure has either an oval or a rectangular cross-section with a large frontal face of 16-33 square inches. The axes of the frontal face preferably have a dimension of 4-5 inches in one direction and 7-8 inches in the other. The typical side wall thickness is about 0.01 inch and the typical cell diameter for each of the channels extending longitudinally thereof is about 0.09 inches.

Ceramic Form Body

The open cell ceramic foam body C is formed as a truncated cone with an exit ring surface 29 at the base of the cone and an entrance throat at the top of the cone. The cone top defines the throat as a neck 32 presenting an entrance surface 30; the exit or trailing portion of the truncated cone provides ring surface 29 which is in intimate contact with the outer portion 25*a* of the entrance face of the filter trap B. The ring surface 29 is defined by the outer periphery of the cone base shape and by a pocket 35 at the central portion of the trailing surface. The ratio of the entrance surface 30 to the exit surface 29 is in the range of $\frac{1}{3}$-$\frac{3}{4}$. The open cell ceramic foam body C is positioned tightly against portion 25*a* of the front face of the filter by way of support straps 36 which extend between the entrance portion at 14 of the transition section 11 and the periphery of the neck 32 of the open cell body B. Exhaust flow will enter the transition section 11 and most flow will preferentially pass through the entrance neck 32 of the open cell body while the remainder of the flow will pass around the throat and enter the tapered section 42 of the cone shape. The pocket tends to setup an insulating space which encourages the flow to exit by passing through the ring surface 29 of the ceramic open cell body.

The open cell body is preferentially coated with a washcoat of palladium and tungsten or fine gamma aluminum to provide a catalytic coating substance to reduce the ignition temperature of contained particulates to the range of 400°-800° F. from that which would normally be in the range of 1000°-1200° F. The open cell ceramic foam body is of the omni-cell type; that is, the cells are not aligned in any particular direction thus promoting porosity that is random like that in a sponge. Typically the average cell diameter of such open cell body is about 0.09-0.130 inch and such porosity promotes collection of 0.6-0.10 grams of soot during a typical filtration cycle. This is in stark contrast to the amount of particulates that would be collected by the particulate trap or filter during the same period and subjected to the same exhaust gas; the later collects in the range of about 28-35 grams of soot.

The open cell foam body is effective to siphon off an ignitable collection of particulates from the exhaust gas during filtration. The pocket 35 located radially inwardly of the ring surface 29 provides a separation between the body and trap thereby forcing heat transfer to be through the ring surface. The open cell body has its cells defined to be in the range of 10-30 cells per lineal inch whereas the cells of the particulate trap are in the range of 40-400 CPI.

Ignition Assembly

The ignition assembly D ignites the siphoned collection of particulates in the open cell body by use of a much smaller energy supply. To this end, electrical resistance wires 42 are cast-in-place or embedded within a radially centralized portion of the open cell body adjacent to the entrance surface 30. The electrical resistance wires 42 when energized are effective to heat the body C during regeneration to a temperature to ignite the siphoned collection. The wires are here designed for a power supply of 20 amps and 45 volts from an alternator of the automobile, and deliver 800-1100 watts of heating. During energization of the electrical heating wires 42, the exhaust flow is bypassed around the filter trap B and open cell body C by operation of valve 20. A pump 43 is actuated to provide a flow of oxygen carrying gas, such as air, at a low flow rate of 1.5 to 10 cfm through the body C. This flow rate contrasts sharply with the normal flow rate of exhaust gas which fluxuates in the range of 100-1500 cfm.

Control

The control E is a device described in detail in U.S. Pat. No. 4,538,411 and is comprised of two pressure sensor/transducers 50 and 51, Sensor/transducer 51 is located to sense the back pressure immediately upstream of the front of the filter trap, which pressure correlates with the degree of particulate collection in the filter or contamination thereof. The other sensor/transducer 50 is placed in the ceramic open pore body C. When the particulate loading (and trap back pressure) reaches a preset trigger condition, the regeneration system is turned on when the air pump, valve 20, and wires 42 are energized.

While particular embodiments of the invention have been illustrated and described, it will be obvious to those skilled in the art that various changes and modifications may be made without departing from the invention, and it is intended to cover in the appended claims all such changes and modifications that fall within the true spirit and scope of the invention.

We claim:

1. An ignition system for regenerating a particulate trap for the exhaust gas of an internal combustion engine, the particulate trap having an entrance face for receiving a gaseous flow therethrough, the system comprising:

(a) a flow guide means effective to direct exhaust gas to said entrance face during filtration by said trap and a gaseous flow during regeneration of said trap;

(b) an open cell ceramic foam body extending across said flow guide means and having (i) radially outer ring surface in contact with the radially outer portion of said entrance face and (ii) an entrance surface remote from said particulate trap, said foam body having a pocket located radially inwardly of said ring surface to provide a separation, between said body and trap, thereby forcing said heat transfer to be through said ring surface, said open cell foam body being effective to trap an ignitable collection of particulates from the exhaust gas during filtration; and (c) electrically energized resistance heating means stationed in a radially central portion of the open cell body adjacent said entrance surface effective to heat said body during regeneration to a temperature effective to ignite said ignitable particulate collection.

2. The system as in claim 1, in which said open cell ceramic foam body has cells numbering 10-30 cells per lineal inch.

3. The system as in claim 1, in which said open cell ceramic foam body is configured as a frustrum of a conical shape, said shape having a neck as an entrance and the base perimeter of said cone defining the outer periphery of said ring surface.

4. The system as in claim 3, in which the ratio of the diameter of said entrance of said open cell foam body to the diameter of the exit surface of said foam body is in the range of $\frac{1}{3}$-$\frac{3}{4}$.

5. The system as in claim 1, in which said open cell foam body is effective to collect 0.3-1.0 grams of soot during a typical filtration cycle.

6. The system as in claim 1, in which said resistance heating means is effective to provide low power for carrying out said regeneration, said low power being in the range of 800-1100 watts of heating.

7. The system as in claim 6, in which the power supply to said electrical heating means provides a current of 20 amps, and a voltage of about 45.

8. The system as in claim 1, in which said open cell ceramic foam body has a washcoat thereon containing catalyst effective to reduce the ignition temperature of said trapped particulate collection to 400°-800° F.

9. The system as in claim 8, in which said catalyst is comprised of palladium and tungsten.

10. The system as in claim 1, in which said gaseous flow during regeneration is comprised of air and is at a flow rate of 1.5 to 10 cfm.

11. The system as in claim 1, in which said particulate trap is comprised of a wall-flow ceramic honeycomb and said guide means is effective to direct the exhaust gas around said filter during regeneration.

12. The system as in claim 11, in which the wall thickness of said wall-flow ceramic trap is 0.01 inch and the cell diameter in the average cell diameter is 0.09 inches.

13. A low power electrical ignition apparatus for regeneration of a bypassable wall-flow particulate trap assembly for an internal combustion engine, the assembly having a filter with an entrance face for receiving a gaseous flow therethrough, and structure for normally channeling exhaust gas flow through said filter during filtration and alternatively channeling an oxidizing gas through said filter while bypassing exhaust gas during regeneration, the apparatus comprising:

(a) flow guide means effective to direct a gaseous flow to and through the entrance of said filter;

(b) an open cell ceramic foam body having an exit surface stationed in intimate contact with the entrance face of said filter to cause the gaseous flow to pass therethrough and trap a collection of particulates therefrom, said foam body having a pocket located radially inwardly of said exit surface to provide a separation; and (c) electrically energized resistance heating means disposed centrally radially within said open cell ceramic foam body, and having electrical power effective to selectively ignite the trapped collection of particulates contained in said ceramic foam body.

14. The apparatus as in claim 13, in which the ratio of soot collected by said open cell foam body, in comparison to the amount of soot collected by said filter trap, is about 1–30.

* * * * *